United States Patent [19]

Doyle

[11] Patent Number: 4,934,646

[45] Date of Patent: Jun. 19, 1990

[54] SKI ROPE HOLDER

[76] Inventor: Patrick W. Doyle, 1003 Stanislaus Way, Santa Rosa, Calif. 95401

[21] Appl. No.: 284,900

[22] Filed: Dec. 15, 1988

[51] Int. Cl.[5] ..... F16L 3/00

[52] U.S. Cl. ..... 248/309.1; 248/51; 248/205.2

[58] Field of Search ..... 248/309.1, 205.2, 311.3, 248/51; 24/306, 442, 16 R, 16 PB; 128/DIG. 15

[56] References Cited

U.S. PATENT DOCUMENTS

| | | | |
|---|---|---|---|
| 2,829,461 | 4/1958 | Tuttle | 248/309.1 X |
| 3,232,289 | 2/1966 | Zimmerman | 128/DIG. 15 X |
| 3,395,882 | 8/1968 | Marshall | 248/311.3 |
| 4,625,719 | 12/1986 | Chambers | 128/DIG. 15 X |
| 4,719,876 | 1/1988 | Wilken | 128/DIG. 15 X |
| 4,759,963 | 7/1988 | Uso, Jr. et al. | 248/205.2 X |

*Primary Examiner*—Alvin C. Chin-Shue
*Attorney, Agent, or Firm*—Larry D. Johnson

[57] ABSTRACT

A ski rope holder comprises a body member having an upper end and a lower end, the upper end bearing a first flap portion forming a strap for attachment to a structural member on the boat. This structural member attachment strap may be horizontally oriented to wrap around a vertical structural member, or vertically oriented to wrap around a horizontal structural member. The body member upper end also bears a second flap portion forming a capture strap for insertion through the central void of the rope coil and surrounding and capture of only one side of the coil. The body member lower end bears a third flap portion forming a capture strap for surrounding and capture of the middle of the entire gathered coil.

4 Claims, 2 Drawing Sheets

SKI ROPE HOLDER

BACKGROUND OF THE INVENTION

1. Field of the Invention

This invention relates generally to ropes, cords, and accessories related thereto, and more specifically to an improved holder device for coiled ropes or other elongate flexible material.

2. Description of the Prior Art

Most lengths of line or rope, such as the tow rope used in water skiing, are preferably kept coiled when not in use, both to prevent tangling of the rope, and to avoid accidents such as those caused by tripping over the rope. Unfortunately, such coils of rope have a tendency to twist, knot or otherwise become disorganized, so it is important to keep the coils secure and intact.

Many known rope holders utilize fixed cleats, posts, or other structural features around which the rope is coiled. Other rope holders utilize a crank to wind the rope up on a rigid spool, and to retain the rope on that spool until it is subsequently unwound. All of these known rope holders tend to be awkward to use and install, especially in the cramped quarters of a boat.

SUMMARY OF THE INVENTION

The ski rope holder of this invention provides a versatile and efficient holding device for coiled line or rope to prevent twisting or uncoiling of the rope, and to permit attachment of the coiled rope to a fixed structural member for storage. The holder comprises a body member having an upper end and a lower end. The upper end bears a first flap portion (or pair of flaps) forming a strap for attachment to a structural member on the boat. This structural member attachment strap may be horizontally oriented to wrap around a vertical structural member (e.g., a boat pylon), or vertically oriented to wrap around a horizontal structural member (e.g., a boat rail).

The body member upper end also bears a second flap portion forming a capture strap for insertion through the central void of the rope coil and surrounding and capture of only one side of the coil, i.e., from the center of the coil to the outside of the coil. This upper rope capture strap is preferably vertically oriented to wrap around the top (horizontal tangent) portion of the coil, and may also be used to surround and retain the handle, if any, of the rope.

The body member lower end bears a third flap portion forming a capture strap for surrounding and capture of the middle of the entire gathered coil, i.e., over both sides and the center of the coil. This lower rope capture strap is preferably horizontally oriented to wrap around the middle or "waist" of the generally vertically-oriented coil of rope hanging from the upper rope capture strap.

The respective flap portions (i.e., attachment strap, upper capture strap, and lower capture strap) preferably include releasable fasteners, such as small patches of hook-and-loop fastener, on complementary surfaces of the flaps. For example, the upper capture strap and lower capture strap can each be formed as a pair of overlapping segments, one segment bearing a patch of the "hook" portion of a hook-and-loop fastener on its outside surface, facing the other segment bearing a patch of the "loop" portion of the hook-and-loop fastener. Thus, the two segments can be readily overlapped and fastened together to capture the rope coil, and just as readily unfastened to release the coil.

The attachment strap, on the other hand, may be formed as a pair of overlapping segments, as above, or may be formed as a single segment overlappable with and fastenable to a surface on the body member itself. Such an arrangement is particularly appropriate with the vertically oriented version of the structural member attachment strap, such as that used to attach the rope holder device to a rail or other horizontal member. Thus, placement of a coil of rope onto the rope holding device of this invention prevents twisting or uncoiling of the rope coil, and permits ready attachment and removal of the intact coil to a structural member on the boat for storage.

DETAILED DESCRIPTION OF A PREFERRED EMBODIMENT

Figure 1:
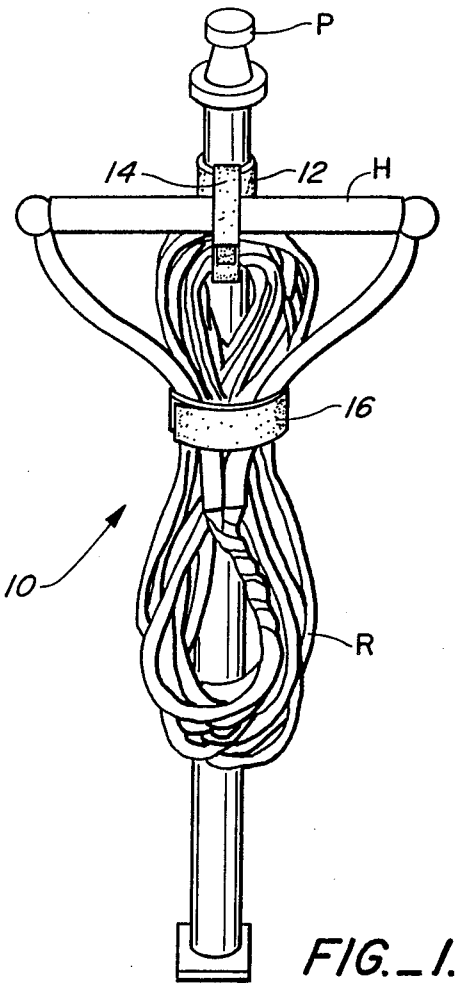
FIG. 1 is a perspective view of a vertical mount embodiment of the ski rope holder device of this invention as installed on a vertical pylon, with the attachment strap secured around the pylon, and a coil of ski rope captured within the upper and lower rope capture straps.

FIG. 1 is a perspective view of a vertical mount embodiment 10 of the ski rope holder device of this invention as installed on a vertical pylon P, with a vertical structural member attachment strap 12 secured around the pylon, and a coil of ski rope R captured within the upper rope capture strap 14 and lower rope capture strap 16. This view also illustrates how ski rope handle H may be captured by upper rope capture strap 14 and held there with the rest of rope coil R.

Figure 2:
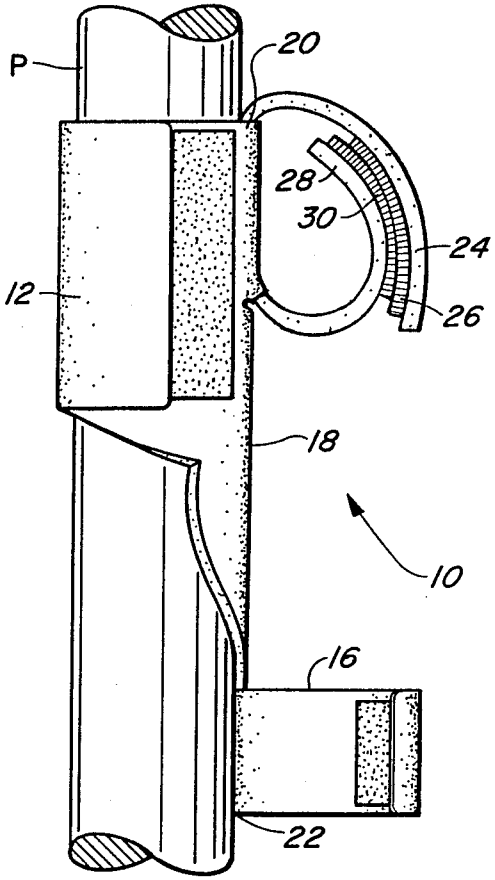
FIG. 2 is a side elevational view of a vertical mount embodiment of the ski rope holder device of this invention as installed on a vertical pylon, illustrating the horizontally oriented vertical structural member attachment strap, the vertically oriented upper rope capture strap, and the horizontally oriented lower rope capture strap.

FIG. 2 is a side elevational view of the vertical mount embodiment 10 of the ski rope holder device as installed on pylon P, illustrating the horizontally oriented vertical structural member attachment strap 12, the vertically oriented upper rope capture strap 14, and the horizontally oriented lower rope capture strap 16. Ski rope holder 10 generally comprises body member 18 having an upper end 20, from which attachment strap 12 and upper capture strap 14 extend, and lower end 22, from which lower capture strap 16 extends.

This view also illustrates how the respective straps include releasable fasteners, such as small patches of hook-and-loop fastener, on complementary surfaces of the straps. For example, upper rope capture strap 14 includes a first end 24 bearing a patch 26 of the hook portion of a hook-and-loop fastener on its inside surface, and a second end 28 bearing a patch 30 of the loop portion of a hook-and-loop fastener on its outside surface, so that patch 26 and patch 30 can be selectively fastened and unfastened. Attachment strap 12 and lower rope capture strap 16 each bear similar releasable fasteners.

Figure 3:
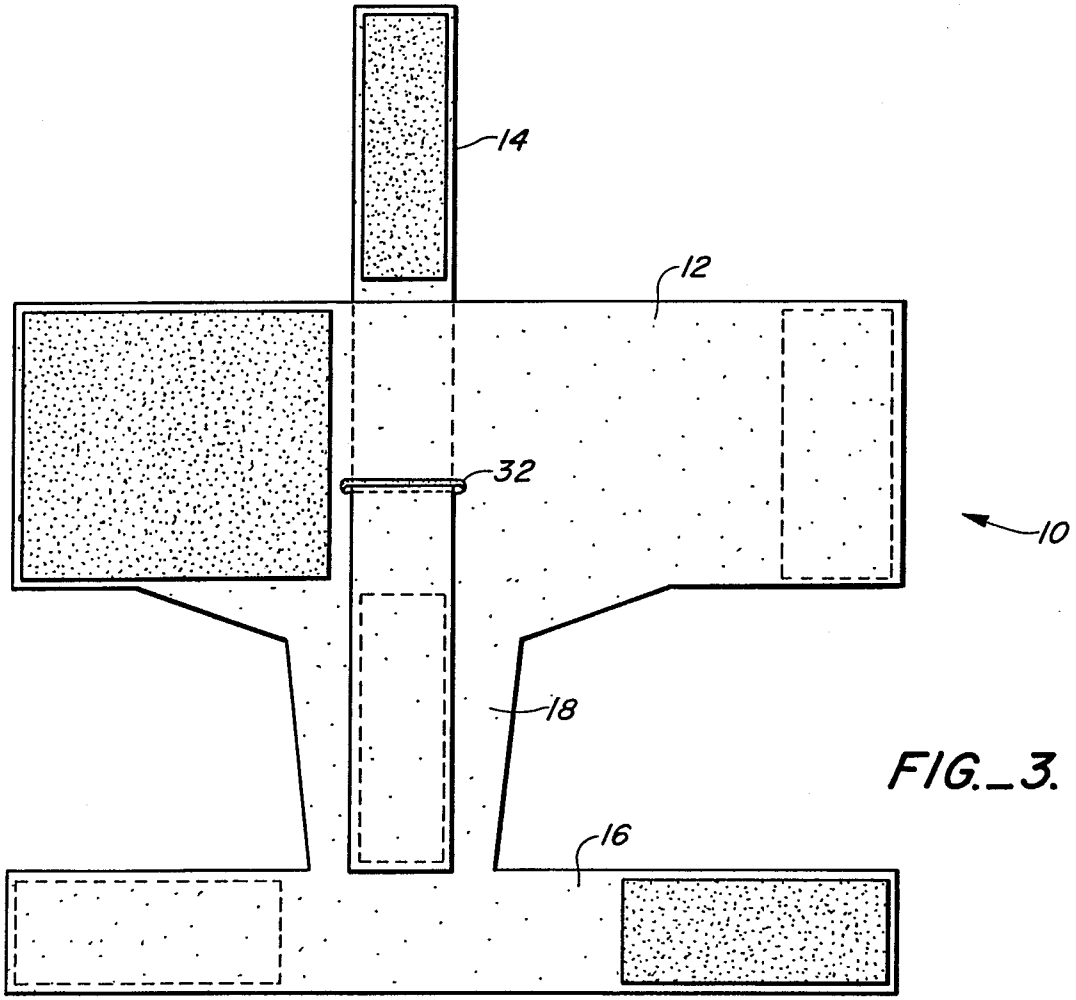
FIG. 3 is a plan view of a vertical mount embodiment of a ski rope holder device of this invention as laid out for manufacture.

FIG. 3 is a plan view of a vertical mount embodiment 10 of the ski rope holder device of this invention as laid out for manufacture. The entire assembly can be made from any suitably strong, flexible material, such as neoprene or Durometer EPDM rubber with the patches of fastener material stitched in place with nylon thread. Such a construction is suitable for marine or other outdoor use, and enables versatility in the size of the rope coils that can be accommodated, and the types of structural members the device can be attached to.

This view also illustrates that the device can be made from two pieces of material, with upper capture strap 14 forming a separate piece insertable through body member 18 at cut 32. The dimensions of the device can of course vary, but extended dimensions of approximately twelve inches by twelve inches will yield a holder device that can accommodate most standard rope coils.

Figure 4:
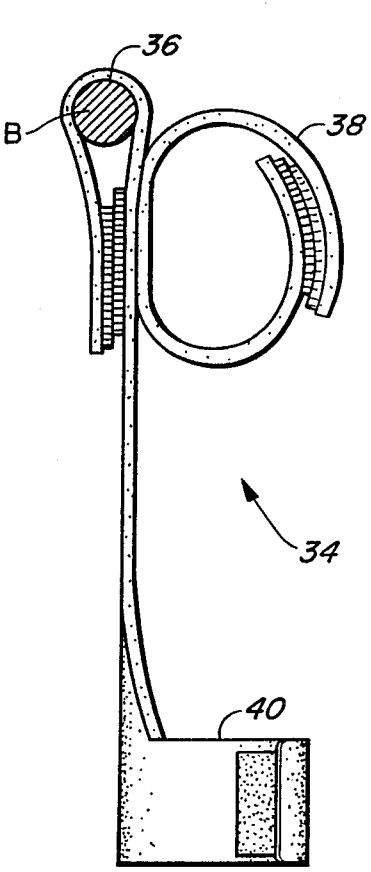
FIG. 4 is a side elevational view of a horizontal mount embodiment of the ski rope holder of this invention, illustrating the vertically oriented horizontal structural member attachment strap.

FIG. 4 is a side elevational view of a horizontal mount embodiment 34 of the ski rope holder of this invention, illustrating the vertically oriented horizontal structural member attachment strap 36. This orientation enables the device to be attached to any horizontal structural member, such as a boat rail B, while still achieving all of the coil-holding benefits of the upper rope capture strap 38 and lower rope capture strap 40.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A holder device for a coil of rope, said coil of rope having a coil top, a pair of coil sides, and a coil center void, said holder device comprising:

a body member having an upper end and a lower end;

a first flap portion attached to said body member upper end, said first flap portion forming an attachment strap conditioned for attachment to a separate structural member;

a second flap portion attached to said body member upper end, said second flap portion forming a vertically oriented upper capture strap for insertion through said coil center void and capture of said coil top of said coil of rope; and a third flap portion attached to said body member lower end, said third flap portion forming a horizontally oriented lower capture strap for surrounding said coil sides and said coil center of said coil of rope.

2. The rope holder device of claim 1 wherein said flap portions each bear releasable fasteners conditioned to enable selective fastening of each of said flap portions to itself.

3. The rope holder device of claim 2 wherein said releasable fasteners comprise complementary portions of hook and loop fastener material.

4. The rope holder device of claim 1 wherein said first flap portion is oriented horizontally to enable attachment to a vertical structural member.

* * * * *